US008998368B2

(12) United States Patent
Igarashi

(10) Patent No.: US 8,998,368 B2
(45) Date of Patent: Apr. 7, 2015

(54) PRINTER AND PRINTING METHOD

(75) Inventor: Hitoshi Igarashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/365,779

(22) Filed: Feb. 3, 2012

(65) Prior Publication Data

US 2012/0200628 A1 Aug. 9, 2012

(30) Foreign Application Priority Data

Feb. 9, 2011 (JP) ..... 2011-025940

(51) Int. Cl.
*B41J 29/38* (2006.01)
*B41J 15/04* (2006.01)
*B41J 11/42* (2006.01)

(52) U.S. Cl.
CPC . *B41J 15/04* (2013.01); *B41J 11/42* (2013.01)

(58) Field of Classification Search
CPC ..... B41J 29/38
USPC ..... 347/14, 16, 19, 104
See application file for complete search history.

(56) References Cited

U.S. PATENT DOCUMENTS

| | | | | |
|---|---|---|---|---|
| 2008/0239052 | A1* | 10/2008 | Ishii et al. | 347/104 |
| 2009/0269119 | A1* | 10/2009 | Hatada et al. | 400/618 |
| 2010/0201732 | A1* | 8/2010 | Naoi et al. | 347/14 |
| 2011/0211031 | A1* | 9/2011 | Satoh et al. | 347/104 |
| 2012/0087707 | A1* | 4/2012 | Igarashi | 400/611 |

FOREIGN PATENT DOCUMENTS

| | | | |
|---|---|---|---|
| JP | 59-064463 | A | 4/1984 |
| JP | 62-171857 | A | 7/1987 |
| JP | 10-230659 | A | 9/1998 |
| JP | 2003-276918 | A | 10/2003 |
| JP | 2009-208921 | A | 9/2009 |
| JP | 2009-256095 | A | 11/2009 |

* cited by examiner

*Primary Examiner* — Manish S Shah
*Assistant Examiner* — Jeremy Delozier
(74) *Attorney, Agent, or Firm* — Global IP Counselors, LLP

(57) ABSTRACT

A printer includes a roll driving mechanism for causing a roll to rotate and a medium to be conveyed, a roll driving section for driving the roll driving mechanism, a first conveying mechanism for conveying the medium, a first driving section for driving the first conveying mechanism, a second conveying mechanism for conveying the medium, and a second driving section for driving the second conveying mechanism, and a controller for performing a control in such a way that when there is a change in the rate at which the first conveying mechanism conveys the medium, the maximum amount of the difference between the amount of the medium conveyed by the roll driving mechanism and the amount of the medium conveyed by the second conveying mechanism exceeds the maximum amount of the difference.

7 Claims, 11 Drawing Sheets

PRINTER AND PRINTING METHOD

CROSS-REFERENCE TO RELATED APPLICATIONS

This application claims priority to Japanese Patent Application No. 2011-025940 filed on Feb. 9, 2011. The entire disclosure of Japanese Patent Application No. 2011-025940 is hereby incorporated herein by reference.

BACKGROUND

1. Technological Field

The present invention relates to a printer and to a printing method.

2. Background Technology

Some printers perform printing by spraying ink from nozzles, causing ink drops (dots) to land on a medium. There are known in the art printers provided with a roll paper printing mechanism for performing printing while appropriately dispensing segments of a medium to be subjected to printing from a medium which has been wound in roll form (roll paper). With this kind of printer, printing is carried out while the amount of the medium conveyed is adjusted by controlling the amount of rotation of the roll paper, and of the amount of rotation of conveyor rollers which convey the medium (paper) once dispensed from the roll paper. In printers provided with a roll paper printing mechanism, during control of the amount of rotation of the roll paper and the conveyor rollers, constant tension is imparted to the medium so that slackness does not arise in the medium as it is being conveyed. However, because the roll diameter of the paper roll changes due to the medium being consumed as printing progresses, the amount of rotation of the roll paper is not appropriately controlled, making it difficult to continue to apply a constant tension to the medium during printing. In order to address such problems, there has been proposed a method whereby the torque setting for the drive motor of the roll paper is controlled in correspondence with changes in roll diameter, to adjust the amount of rotation of the roll paper and impart constant tension to the medium despite changes in roll diameter (Patent Citation 1, for example).

Japanese Laid-open Patent Publication No. 2009-208921 (Patent Document 1) is an example of the related art.

SUMMARY

Problems to be Solved by the Invention

In the method of Patent Citation 1, no consideration is given to the effects of error in attaching the roll paper, mechanical manufacturing error, or inertia occurring in association with imperfect alignment of the rotation axis of the roll paper due to deterioration over time. For example, in cases where roll paper of large roll diameter is employed for printing, such as in commercial large-format printers and the like, the effect of inertia occurring in association with imperfect alignment of the rotation axis increases in association with greater diameter. During control of the drive motor of the roll paper and of the conveyor rollers, as the effect of inertia occurring in association with imperfect alignment becomes greater, the responsiveness of the motor or other components during acceleration or deceleration declines, and the accuracy of control is diminished. In particular, because it is sometimes necessary for the conveying and halting of a medium during printing to be controlled by the conveyor rollers, the effect of inertia on the operation of the conveyor rollers can make it difficult for the medium to be conveyed properly. It is an object of the invention to convey a medium so as not to be susceptible to the effects of inertia arising due to imperfect alignment in a printer provided with a roll paper printing mechanism.

Means Used to Solve the Above-Mentioned Problems

The principal invention for achieving the aforedescribed object is a printer provided with (A) a roll driving mechanism for causing a roll onto which a medium has been wound in a roll form to rotate, and for conveying the medium in a conveying direction, and a roll driving section for driving the roll driving mechanism; (B) a first conveying mechanism for conveying the medium, the first conveying mechanism being provided downstream from the roll in the conveying direction, and a first driving section for driving the first conveying mechanism; (C) a print head for performing printing on the medium, the print head being provided downstream from the first conveying mechanism in the conveying direction; (D) a second conveying mechanism for conveying the medium, the second conveying mechanism being provided between the roll and the first conveying mechanism, and a second driving section for driving the second conveying mechanism; and (E) a controller for controlling operation of the roll driving section, the first driving section, and the second driving section in such a way that during a single rotation of the roll the maximum amount of the difference between the amount of the medium conveyed by the roll driving mechanism and the amount of the medium conveyed by the second conveying mechanism exceeds the maximum amount of the difference between the amount of the medium conveyed by the second conveying mechanism and the amount of the medium conveyed by the first conveying mechanism. Other features of the invention will become apparent from the disclosure of the Specification and accompanying drawings.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
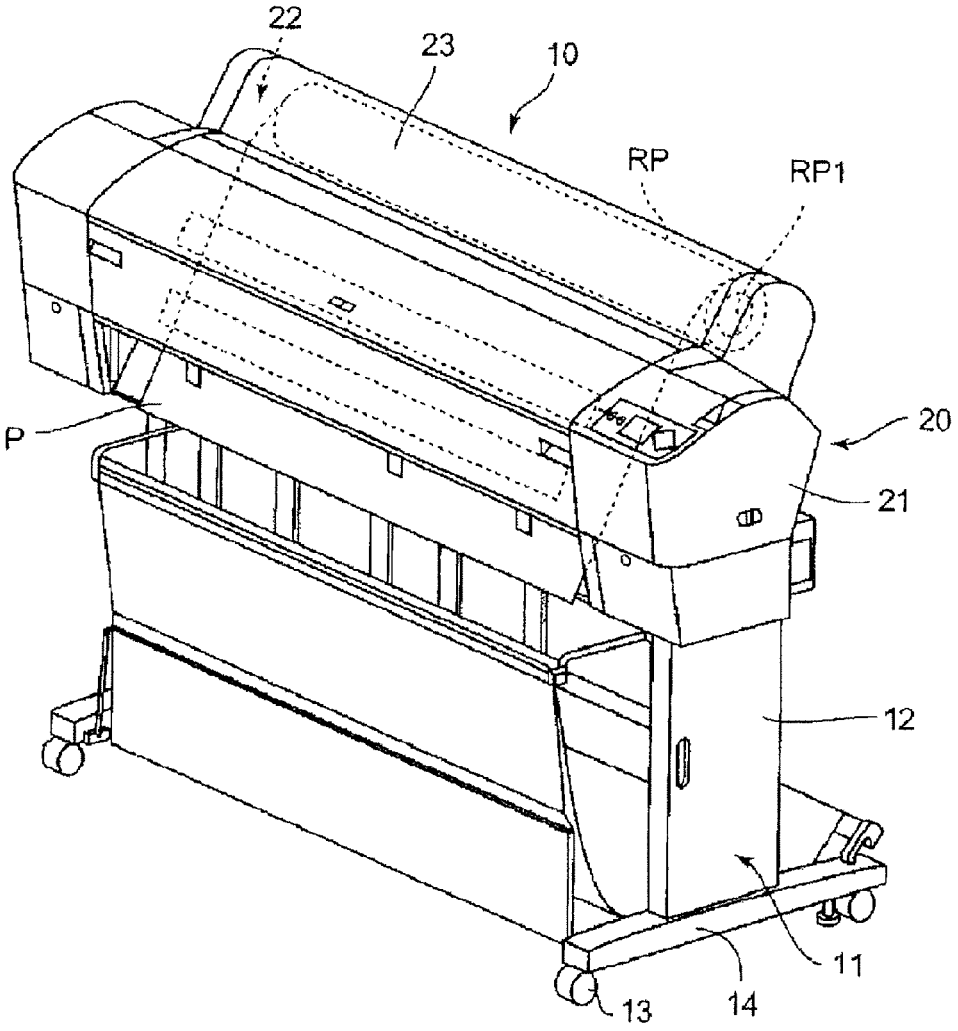
FIG. 1 is a perspective view showing a configuration example of the exterior of a printer according to the present embodiment.

At a minimum, the following aspects will be apparent from the present Specification and accompanying drawings. A printer provided with (A) a roll driving mechanism for causing a roll onto which a medium has been wound in a roll form to rotate, and for conveying the medium in a conveying direction, and a roll driving section for driving the roll driving mechanism; (B) a first conveying mechanism for conveying the medium, the first conveying mechanism being provided downstream from the roll in the conveying direction, and a first driving section for driving the first conveying mechanism; (C) a print head for performing printing on the medium, the print head being provided downstream from the first conveying mechanism in the conveying direction; (D) a second conveying mechanism for conveying the medium, the second conveying mechanism being provided between the roll and the first conveying mechanism, and a second driving section for driving the second conveying mechanism; and (E) a controller for controlling operation of the roll driving section, the first driving section, and the second driving section in such a way that during a single rotation of the roll the maximum amount of the difference between the amount of the medium conveyed by the roll driving mechanism and the amount of the medium conveyed by the second conveying mechanism exceeds the maximum amount of the difference between the amount of the medium conveyed by the second conveying mechanism and the amount of the medium conveyed by the first conveying mechanism. According to the printer of the aspect described above, a medium can be conveyed in a manner not susceptible to the effects of errors in attaching the roll paper, mechanical manufacturing error, or inertia occurring in association with imperfect alignment of the rotation axis of the roll paper due to deterioration over time.

In the printer in question, in preferred practice, during an interval from when the first conveying mechanism starts conveying the medium to when the first conveying mechanism ends conveying the medium, the controller controls the operation of the roll driving section, the first driving section, and the second driving section in such a way that the maximum amount of the difference between the amount of the medium conveyed by the roll driving mechanism and the amount of the medium conveyed by the second conveying mechanism exceeds the maximum amount of the difference between the amount of the medium conveyed by the second conveying mechanism and the amount of the medium conveyed by the first conveying mechanism. According to this printer, a medium can be conveyed in a manner minimally affected by inertia, even at times of acceleration or deceleration of the conveying rollers, which are susceptible to the effects of inertia.

In the printer in question, in preferred practice, during an interval from when printing starts to when printing ends, the controller controls the operation of the roll driving section, the first driving section, and the second driving section in such a way that the maximum amount of the difference between the amount of the medium conveyed by the roll driving mechanism and the amount of the medium conveyed by the second conveying mechanism exceeds the maximum amount of the difference between the amount of the medium conveyed by the second conveying mechanism and the amount of the medium conveyed by the first conveying mechanism. According to this printer, during every printing operation, a medium can be conveyed in a manner minimally affected by inertia.

In preferred practice, the printer in question is further includes an amount-of-slackness detector for detecting the amount of slackness in the medium between the roll driving mechanism and the second conveying mechanism; and the controller drives the roll driving mechanism in a case where the amount of slackness detected by the amount-of-slackness detector is equal to or less than a predetermined amount of slackness, and stops the roll driving mechanism in a case where the amount of slackness detected by the amount-of-slackness detector exceeds the predetermined amount of slackness. According to this printer, a medium can be conveyed in a manner minimally affected by inertia, while controlling driving of the roll exclusively through the amount of slackness.

In the printer in question, in preferred practice, the controller detects the amount of slackness in the medium between the roll driving mechanism and the second conveying mechanism on the basis of the amount of the medium conveyed by the roll driving mechanism and the amount of the medium conveyed by the second conveying mechanism, drives the roll driving mechanism in a case where the detected amount of slackness is equal to or less than a predetermined amount of slackness, and stops the roll driving mechanism in a case where the detected amount of slackness exceeds the predetermined amount of slackness. According to this printer, a medium can be conveyed in a manner minimally affected by inertia, while controlling driving of the roll exclusively through the amount of slackness, and without employing extra instruments such as a slackness sensor or the like.

Also apparent is a printing method including the steps of: (A) driving a roll driving mechanism for driving a roll on which a medium has been wound into roll form and conveying the medium in a conveying direction; (B) driving a first conveying mechanism provided downstream from the roll in the conveying direction, and conveying the medium; (C) printing on the medium by a print head provided downstream from the first conveying mechanism in the conveying direction; (D) driving a second driving mechanism provided between the roll and the first conveying mechanism and conveying the medium; and (E) during a single rotation of the roll, causing the maximum amount of the difference between the amount of the medium conveyed by the roll driving mechanism and the amount of the medium conveyed by the second conveying mechanism to exceed the maximum amount of the difference between the amount of the medium conveyed by the second conveying mechanism and the amount of the medium conveyed by the first conveying mechanism.

Basic Printer Configuration

There shall now be described the printer used as the printer and a drive control method. The printer of the present embodiment is one adapted to print media of large size (e.g., printer paper of JIS size A2 or larger). While the printer in the present embodiment is an inkjet printer, any method of spraying can be employed in the inkjet printer, provided that the device is one capable of printing by spraying ink. In the following description, "lower side" indicates the side where the printer is installed, and "upper side" indicates the side away from the installation side. The side from which the medium is fed is described as being the "feed side" (distal edge side), and the side at which the medium is expelled as the "paper discharge side" (proximal edge side).

Configuration of the Printer

Figure 2:
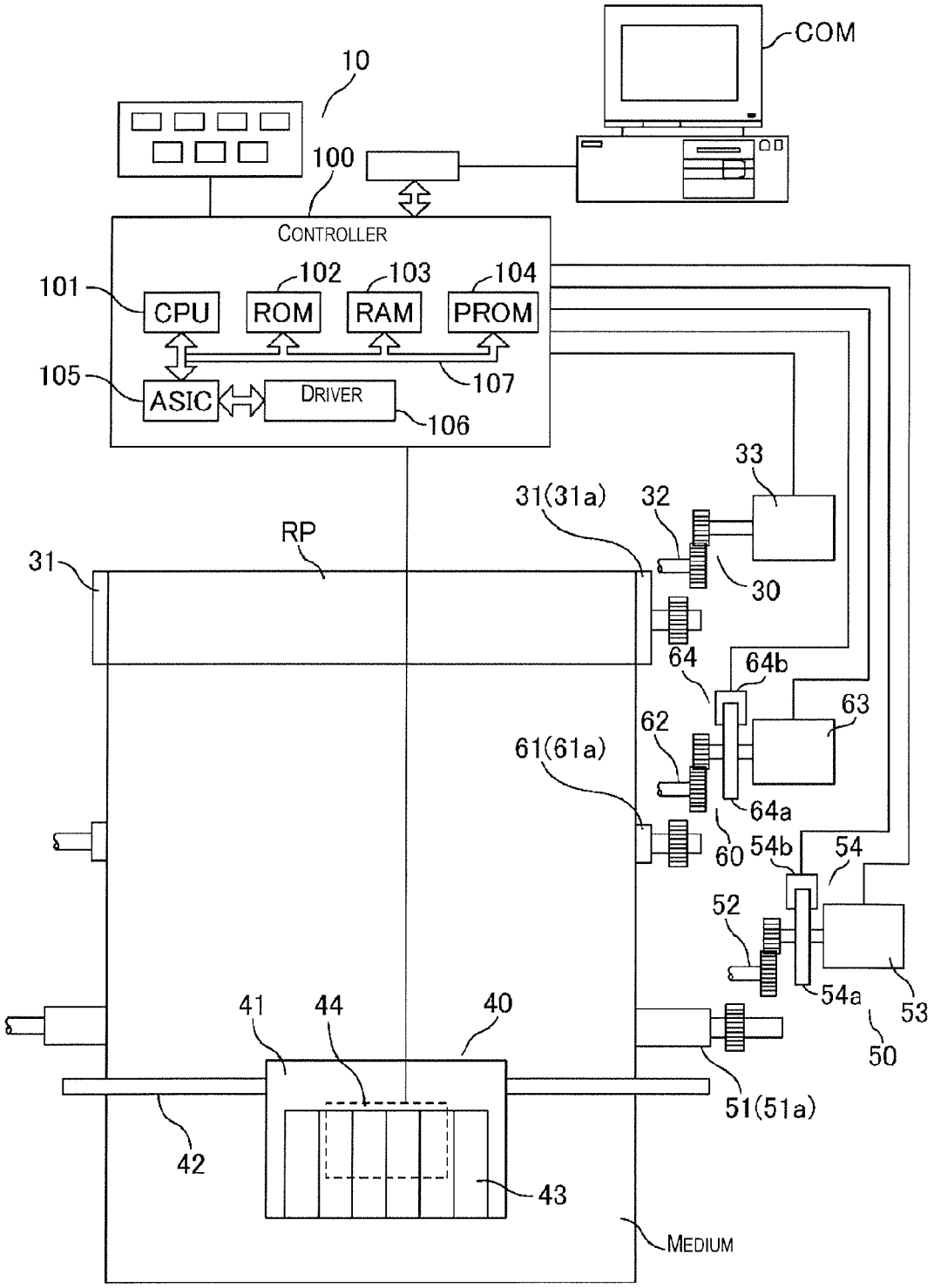
FIG. 2 is a diagram representing the relationship between a control system and a drive system employing a DC motor in a printer.
Figure 3:
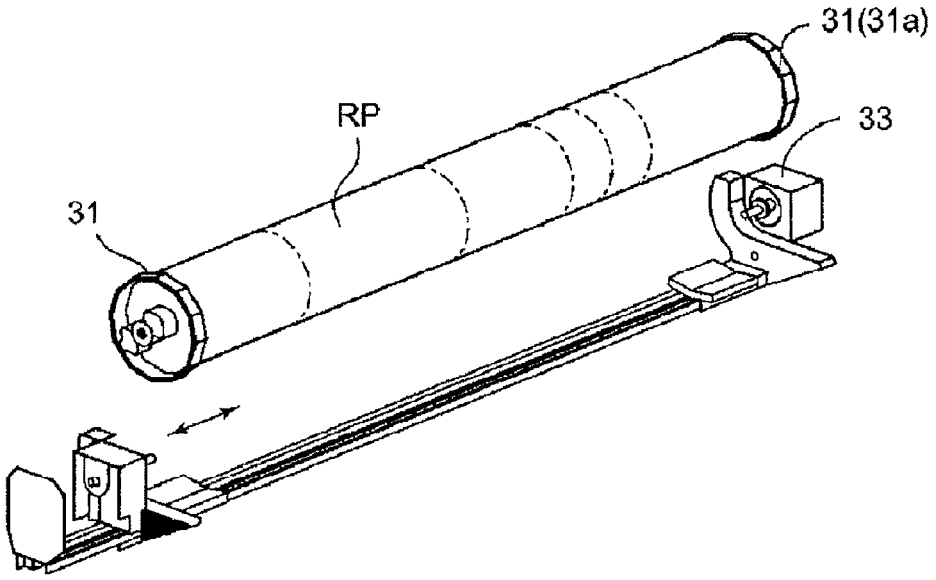
FIG. 3 a perspective view showing a configuration of a rotating holder for retaining a roll.

FIG. 1 is a view showing a configuration example of the exterior of a printer 10 according to the present embodiment. FIG. 2 is a diagram representing the relationship between a control system and a drive system employing a DC motor in the printer 10 of FIG. 1. FIG. 3 is a view showing a configuration example of the exterior of a rotating holder 31 and a roll motor 33. In this case, the printer 10 has a pair of leg sections 11, and a main section 20 supported on the leg sections 11. The leg sections 11 are provided with support posts 12, and rotatable casters 13 are attached to caster mounting sections 14.

Within the interior of the main section 20, various devices mounted in a state of support on a chassis (not shown) are covered by an exterior case 21. As shown in FIG. 2, the main section 20 is provided with a roll driving mechanism 30, a carriage driving mechanism 40, a medium conveying mechanism 50, and a conveying adjustment mechanism 60, as a drive system employing a DC motor.

The roll driving mechanism 30 is provided to a roll mounting section 22 located in the main section 20. As shown in FIG. 1, the roll mounting section 22 is provided to the back face side and upper side in the main section 20. Opening a reclosable cover 23 which is an element of the aforementioned outer case 23 makes it possible for a roll RP to be mounted in the interior thereof so that the roll RP can be rotatably driven by the roll driving mechanism 30. As shown in FIGS. 2 and 3, the roll driving mechanism 30 adapted for causing the roll RP to rotate has rotating holders 31, a gear train 32, and a roll motor 33. The rotating holders 31 are provided as a pair, and are designed to be inserted from both ends into a bore hole RP1 provided to the roll RP so as to support the roll RP from both ends. On the roll RP is wound a medium (for example, paper P) in roll form; as the roll RP rotates, the paper P is drawn out in segments for use in printing, and fed to the medium conveying mechanism 50 and the conveying adjustment mechanism 60.

Also, as shown in FIG. 3, since the entire applied weight of the roll RP bears down on joined sections of the rotating holders 31 and the roll motor 33, the effects of inertia occurring in association with imperfect alignment of the rotation axis can be considerable in cases where the rotation axis of the rotation motor is skewed by the applied weight, the rotating holders 31 at either end of the roll RP are not attached in parallel, or there is variance in the diameter of the bore hole RP1 and the diameter of the rotating holders 31.

The roll motor 33 imparts drive force (rotational force) via the gear train 32 to a rotating holder 31*a* that is one of the pair of rotating holders 31 positioned on one end. Specifically, the roll motor 33 corresponds to the motor for imparting drive force to rotate the roll RP. The rotation direction of the roll motor 33 can be changed as required. Hereinbelow, the orientation of rotation of the roll motor 33 when the medium is dispensed in the feed direction (also referred to as the "conveying direction") is termed normal rotation, and rotation in the reverse direction is termed reverse rotation. The drive section for causing the roll RP to rotate by the roll driving mechanism 30 is not limited to being a motor such as the roll motor 33; it can be an actuator operated by hydraulic pressure, or the like.

The carriage driving mechanism 40 is provided with a carriage 41 also constituting part of an ink feed/spray mechanism, and a carriage shaft 42, as well as a carriage motor, belt, and the like (not shown). The carriage 41 is provided with an ink tank 43 for holding inks of several colors, and it is possible for ink from ink cartridges (not shown) fixedly provided to the front face side of the main section 20 to be fed into this ink tank 43 via tubes (not shown). As shown in FIG. 2, a print head 44 capable of spraying ink droplets is provided to the bottom face of the carriage 41. The print head 44 is provided with nozzle rows (not shown) associated with each of the inks, there being piezo elements disposed in the nozzles constituting the nozzle rows. Through operation of these piezo elements, it is possible to spray ink drops from the nozzles at the ends of ink passages.

The carriage 41, the ink tank 43, the print head 44, and the tubes and ink cartridges (not shown) constitute an ink feed/spray mechanism. The print head 44 is not limited to a piezo-driven system employing piezo elements; there can also be adopted other systems, such as a heater system whereby the ink is heated by a heater, and the force of a bubble produced thereby is utilized; a magnetostrictive system employing magnetostrictor elements; or a mist system in which a mist is controlled by an electrical field. The ink filling the ink cartridges/ink tank 43 can be of any type, such as dye-based inks or pigment-based inks.

Figure 4:
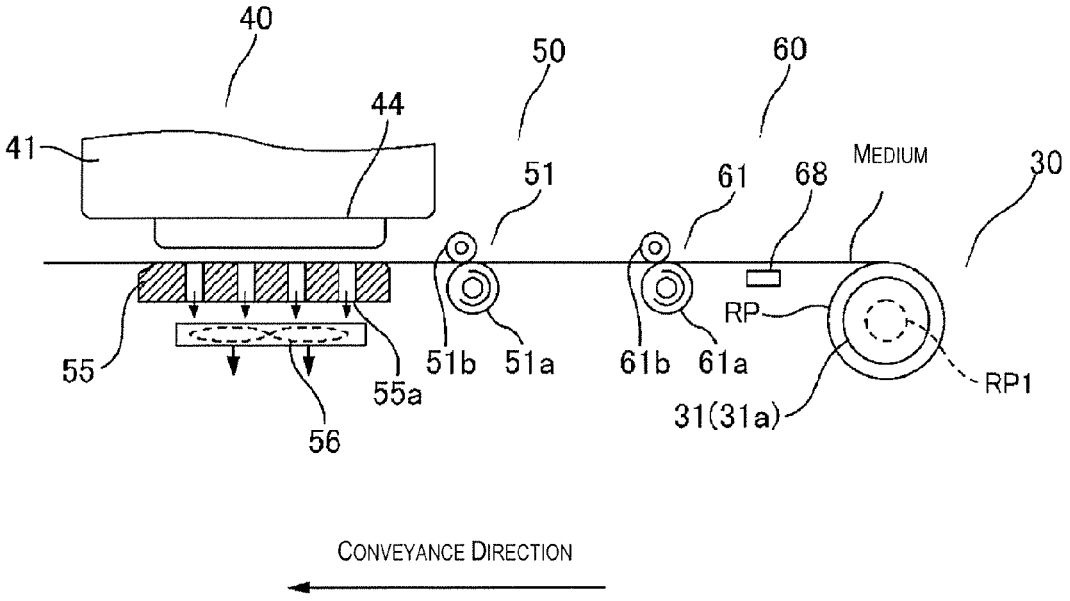
FIG. 4 is a diagram representing positional interrelationship between a roll, a pair of conveyor rollers, a pair of conveying adjustment rollers, and a print head.

FIG. 4 is a view showing positional interrelationships between a medium conveyed from the roll RP, a pair of conveying rollers 51, a pair of conveying adjustment rollers 61, and the print head 44. As shown in FIGS. 2 and 4, the medium conveying mechanism 50 has the conveying roller pair 51, a gear train 51, a PF motor 53, and a rotation detector 54. The conveying roller pair 51 is provided with a conveying roller 51*a* and a conveying follower roller 51*b*, between which it is possible for a medium (for example, paper P) to be nipped as it is drawn out and conveyed. In the medium conveying mechanism 50 of the printer 10 of the present embodiment, the medium is conveyed by rollers; however, the conveying method of the medium conveying mechanism 50 is not limited to one employing rollers. For example, a conveying method employing a suctioning mechanism is acceptable as well.

The PF motor 53 imparts drive force (rotational force) to the conveying roller 51*a* via the gear train 52. Specifically, the PF motor 53 corresponds to the motor for imparting drive force to cause the conveying roller 51*a* to rotate. Similarly with respect to the roll motor 33, the rotation direction of the PF motor 53 can be changed as required. The orientation of rotation of the PF motor 53 when the medium is dispensed in the conveying direction is termed normal rotation, and rotation in the reverse direction is termed reverse rotation. The drive section for driving the conveying roller 51*a* is not limited to being a motor such as the PF motor 53; it can instead be an actuator operated by hydraulic pressure, or the like.

The rotation detector 54 of the present embodiment employs a rotary encoder. Therefore, the rotation detector 54 is provided with a disc-shaped scale 54*a* and a rotary sensor 54*b*. At fixed intervals along the circumferential direction of the disc-shaped scale 34*a* are arranged a light transmission part for transmitting light, and a light-blocking part for blocking light transmission. The rotary sensor 54*b* has as principal components a light-emitting element (not shown); a photoreceptor element (not shown); and a signal processing circuit (not shown).

Figure 5A:
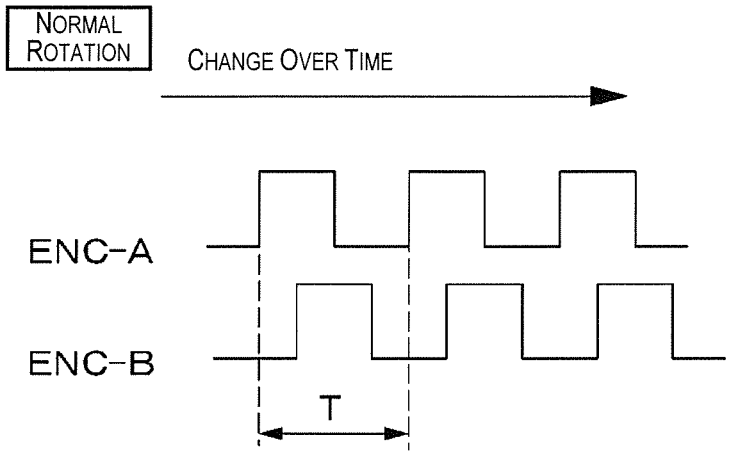
FIG. 5 is a diagram representing ENC signals.
Figure 5B:
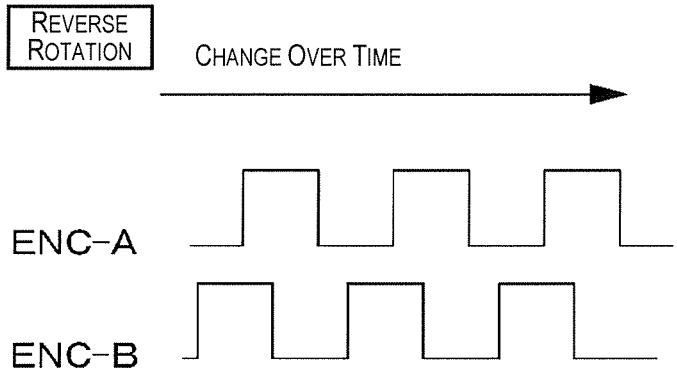

FIG. 5A is a timing chart of waveforms of output signals during normal rotation of the PF motor. FIG. 5B is a timing chart of waveforms of output signals during reverse rotation of the PF motor. In the present embodiment, pulse signals whose phases differ from one another by 90° (a Phase A ENC signal and a Phase B ENC signal) represented in FIGS. 5A and 5B are input to the controller 100 by the output of the rotary sensor 54*b*. Therefore, through advancing or delaying the phase, it is possible to detect whether the PF motor 53 is in the forward rotating state or the reverse rotating state.

A platen 55 is provided to the downstream side (paper discharge side) in the conveying direction from the conveying roller pair 51, and the medium is guided over the platen 55 (FIG. 4). The print head 44 is arranged on the upper side of the opposing platen 55. Suction holes 55*a* are formed in this platen 55. The suction holes 55*a* are provided in communicating fashion with a suction fan 56, and through operation of the suction fan 56, air is sucked in from the print head 44 side via the suction holes 55*a*. Therefore, in cases where the medium is located on the platen 55, it is possible for the medium to be held in place by suction. The printer 10 is additionally provided with a medium-width-detection sensor for detecting the width of the medium, and with various other types of sensors.

The configuration of the conveying adjustment mechanism 60 is substantially similar to that of the medium conveying mechanism 50, and, as represented in FIG. 2, has a conveying adjustment roller pair 61, a gear train 62, and FC motor 63, and a rotation detector 64. The conveying adjustment roller pair 61 is provided with a conveying adjustment roller 61*a* and an adjustment follower roller 61*b*, between which it is possible for the medium to be nipped as it is drawn out from the roll RP. The FC motor 63 imparts drive force (rotational force) to the adjustment roller pair 61 via the gear train 62. Specifically, the FC motor 63 corresponds to the motor for imparting drive force to rotate the conveying adjustment roller 61*a*. Like the roll motor 33, the rotation direction of the FC motor 63 can be changed as required. Herein, the orientation of rotation of the FC motor 63 when the medium is dispensed in the conveying direction is termed normal rotation, and rotation in the reverse direction is termed reverse rotation. The drive section for driving the conveying adjustment roller 61*a* is not limited to being a motor such as the FC motor 63; it can instead be an actuator operated by hydraulic pressure, or the like. The conveying adjustment mechanism 60 is positioned between the roll RP and the conveying adjustment roller pair 61, and has the function of adjusting the amount of conveyance of the medium. Adjustment of the amount of conveyance of the medium is discussed in detail below.

A slackness sensor 68 is provided between the conveying adjustment roller pair 61 and the roll RP. The slackness sensor 68 is a sensor disposed to the lower side of the medium, and is adapted for detecting the position of the medium in a vertical direction (relative position of the slackness sensor 68 and the medium in the vertical direction) between the conveying adjustment roller pair 61 and the roll RP. Using the slackness sensor 58 makes it possible to ascertain the amount of slackness, which expresses how much slackness is present in the vertical direction at the conveying position in a case where the medium is being conveyed in an unslackened state (a tensioned state).

Controller

Figure 6:
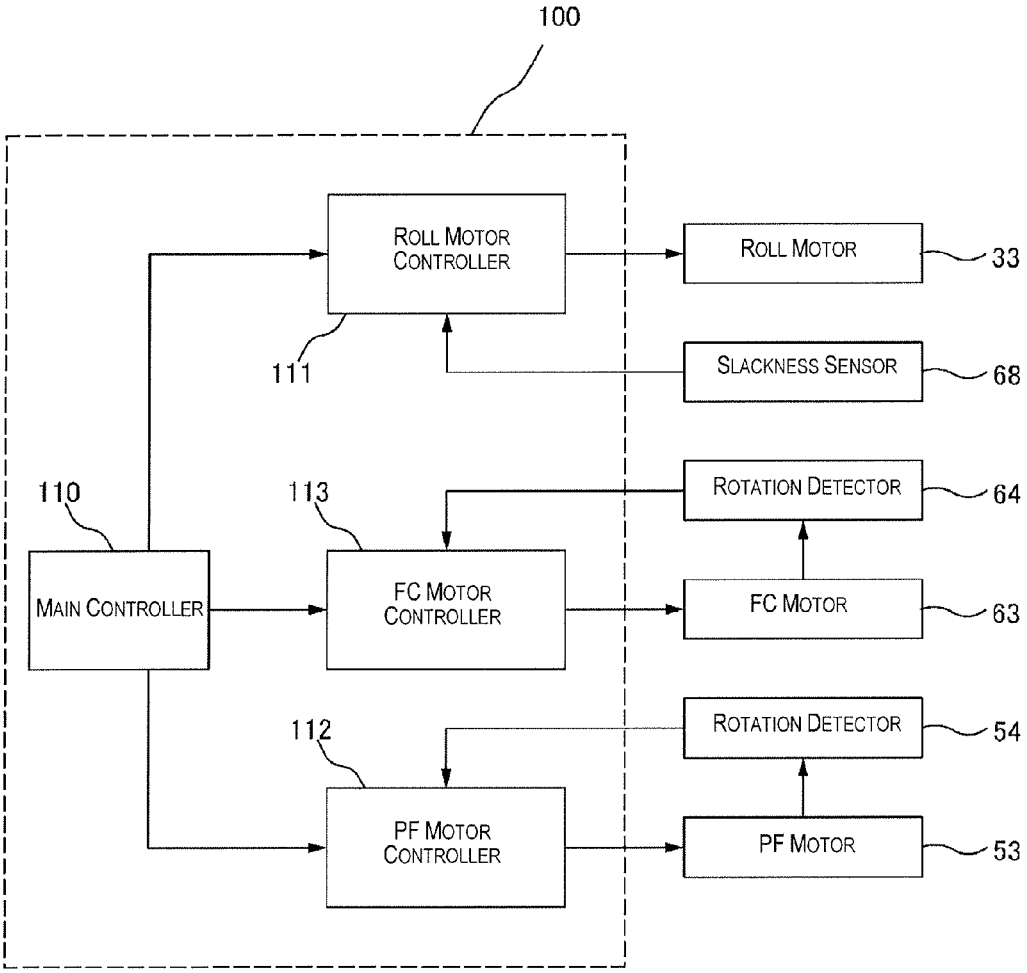
FIG. 6 is a block diagram representing a functional configuration example of a controller.

FIG. 6 is a block diagram representing a functional configuration example of the controller 100 in the first embodiment. In the first embodiment, output signals from the rotation detector 54 of the medium conveying mechanism 50, the rotation detector 64 of the conveying adjustment mechanism 60, the slackness sensor 68, and a linear sensor (not shown) are input to the controller 100. Additionally, output signals from a paper detection sensor, a gap detection sensor, a power switch for switching the power supply of the printer 10 on or off, and the like (none of which shown) are input as well. As shown in FIG. 2, the controller 100 is provided with a CPU 101, a ROM 103, a RAM 103, a PROM 104, an ASIC 105, a motor driver 106, and the like, these components being interconnected via a transmission path 107 such as a bus or the like. The controller 100 is also connected to a computer COM. The functions of a main controller 110, a roll motor controller 111, a PF motor controller 112, and an FC motor controller 113, as represented in FIG. 6, are realized through cooperation between the above hardware and software stored in the ROM 102 or PROM 104, or through additional circuits or constitutional elements for performing specific processes.

The main controller 110 controls the operation of the roll motor controller 111, the PF motor controller 112, and the FC motor controller 113; and performs a process for conveying the medium in the conveying direction. During this time, the balance of the amount of conveyance of the medium by the conveying roller 51*a* and the amount of conveyance of the medium fed (conveyed) from the roll RP is adjusted and a control is performed such that the medium conveying mechanism 50 is not affected by inertia of the roll RP. On the basis of an output signal from the slackness sensor 68, the roll motor controller 111 controls the roll motor 33 in such a way that the proper amount of the medium is fed (conveyed) to the medium conveying mechanism 50 of the printer 10. On the basis of an output signal from the rotation detector 54, the PF motor controller 112 controls driving of the PF motor 53. The amount of rotation of the conveying roller 51*a* is controlled as the medium is thereby conveyed in the conveying direction. On the basis of an output signal from the rotation detector 64, the FC motor controller 113 controls driving of the FC motor 63. The amount of rotation of the conveying adjustment roller 61*a* is thereby controlled, as are the amount of the medium fed from the roll RP, as well as the amount of the medium conveyed by the conveying roller 51*a*.

Printing Operation

When the printer 10 receives print data from the computer COM, the controller 100 controls the various units such as the roll drive roll driving mechanism 30, the carriage driving mechanism 40, and the like to perform the paper supply process, the dot forming process, the conveying process, etc. The paper supply process is a process for feeding a medium to be printed into the printer 10 from the roll RP, and positioning the paper at a printing start position (also termed the header position). The controller 100 causes the roll RP to rotate in the normal direction and advances the medium to the conveying adjustment roller 61*a* and the conveying roller 51*a*. Next, the conveying adjustment roller 561*a* and the conveying roller 51*a* rotate to position the paper advanced from the roll RP at the printing start position.

The dot forming process is a process for intermittently spraying ink from the print head 44 as it travels along a direction perpendicular to the conveying direction of the medium (also called the traveling direction), to form ink dots on the medium. The controller 100 causes the carriage 41 to travel in the traveling direction, and as the carriage 41 travels in the traveling direction, sprays ink from the print head 44 on the basis of the print data. When the sprayed ink droplets land on the medium they form dots, forming dot lines composed of a plurality of dots along the traveling direction on the medium.

The conveying process is a process for bringing about travel of the medium relative to the head in the conveying direction. The controller 100 causes the conveying roller 51*a* to rotate and conveys the paper in the conveying direction.

Through this conveying process, it is possible for the print head 44 to form dots at positions different from the positions of the dots that were formed by the previous dot forming process. Control of the amount of advance of the medium during conveying is discussed below.

The controller 100 repeats the dot forming process and the conveying process in alternating fashion until no print data remains, to progressively print out onto the paper an image constituted by dot lines. Finally, the controller 100 discharges the medium once printing of the image is finished.

COMPARATIVE EXAMPLE

Figure 7:
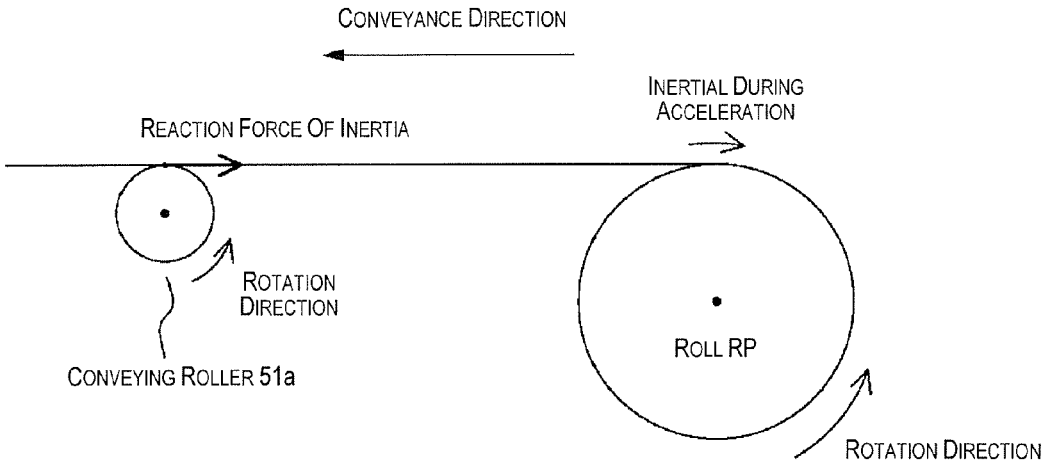
FIG. 7 is a diagram schematically depicting rotation of various rollers when a medium is conveyed in a comparative example.

First, conveying of a medium in the absence of the conveying adjustment mechanism 60 will be described by way of a Comparative Example. FIG. 7 schematically depicts rotation of the various rollers when a medium is conveyed in the comparative example. In the printer of the Comparative Example, the medium dispensed from the roll RP advances directly to the conveying roller 51*a* without passing by a conveying adjustment roller 61*a*, the medium being conveyed by normal rotation of the conveying roller 51*a*.

Let it be assumed that, in a printer such as that discussed above, printing is performed with a roll RP of large roll diameter. If the alignment is imperfect during feeding of the medium, the effect from inertia due to the imperfect alignment will increase in proportion to factors such as the roll diameter, roll weight, and the amount of misalignment between the normal proper position of the rotation axis (theoretical center) and the position of the center during actual rotational operation (actual center) (amount of imperfect alignment). Inertia caused by imperfect alignment occurring in the roll RP affects the rotational operation of the conveying roller 51*a* through the medium. For example, when alignment is imperfect, inertia imparted to the conveying roller 51*a* by the roll RP and the roll paper positioned between the roll RP and the conveying roller 51*a* will be unstable because the amount of the roll paper delivered from the roll when the roll has rotated by a given angle will differ depending on the positions of the theoretical center and the actual center. A risk of disturbing the conveying operation and degrading print quality is presented.

First Embodiment

Figure 8:
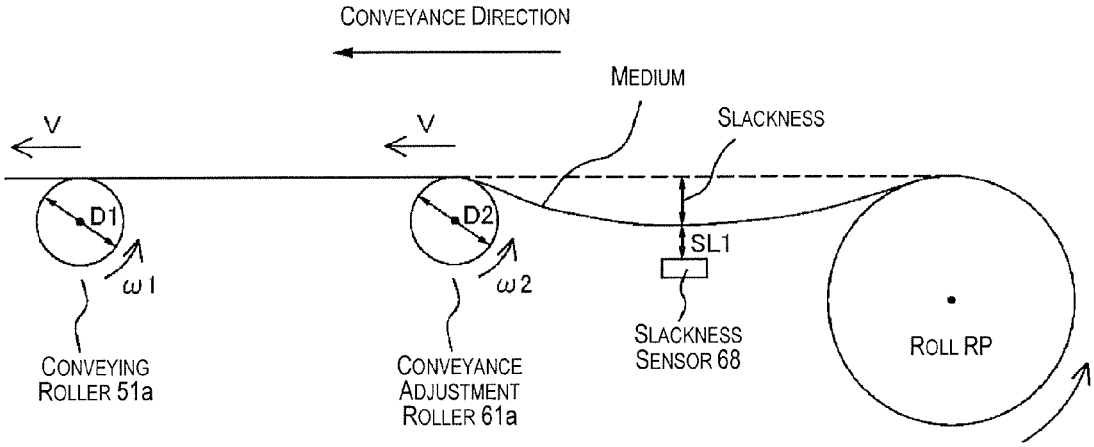
FIG. 8 is a diagram schematically depicting rotation of various rollers and slackness of a medium when a medium is conveyed in a first embodiment.

In a case such as that discussed above, where the roll RP is large (heavy), inertia caused by imperfect alignment is commensurately greater, and conveyance control becomes more difficult. Thus, according to the present embodiment, the conveying adjustment roller 61*a* is provided between the conveying roller 51*a* and the roll RP. FIG. 8 schematically depicts rotation of various rollers and slackness in the medium when it is conveyed in the first embodiment. During the printing operation (conveying of the medium), a control is performed such that the medium is conveyed in an unslackened state between the conveying adjustment roller 61*a* and the conveying roller 51*a*, while a control is performed such that the medium is kept in a constant state of slackness between the conveying adjustment roller 61*a* and the roll RP. Because the medium slackens between the conveying adjustment roller 61*a* and the roll RP, the effects of inertia due to the roll RP are absorbed by the slack portion of the medium, whereby the effects of inertia on the conveying roller 51*a* are minimized. Control of rotation of each of the rollers is described below.

Controlling Rotation of Conveyor Roller 51*a*

The conveying roller 51*a* conveys the medium in the conveying direction at a given rate V. The rate V at which the medium is conveyed by the conveying roller 51*a* is expressed by formula (1):

$$V=\omega 1\times D1/2 \quad (1)$$

(D1 is the diameter of the conveying roller 51*a* (roller diameter) and ω1 is the angular velocity when the roller is rotating). The PF motor controller 112 performs PWM output and drives the PF motor 53 so that the conveying roller 51*a* will be caused to rotate at angular velocity ω1. The amount of rotation made by the PF motor per unit time is detected by the rotation detector 54, and the current angular velocity of the conveying roller 51*a* is calculated according to the relationship between the detected amount of rotation and the gear ratio of the gear train 52. The PF motor controller 112 properly controls the rate of rotation of the conveying roller 51*a* so that the calculated angular velocity approaches the target angular velocity ω1, and the medium is stably conveyed.

Controlling Rotation of Conveying Adjustment Roller 61*a*

The conveying adjustment roller 61*a* follows the conveying roller 51*a*, and conveys the medium in the conveying direction at the same rate V as the conveying roller 51*a*. The medium is thereby conveyed between the conveying roller 51*a* and the conveying adjustment roller 61*a* while the amount of the medium is kept constant at all times. The rate V at which the medium is conveyed by the conveying adjustment roller 61*a* is expressed by formula (2)

$$V=\omega 2\times D2/2 \quad (2)$$

(D2 is the diameter of the conveying adjustment roller 61*a* (roller diameter) and ω2 is the angular velocity when the roller is rotating). In a case where V is the same in (1) and (2), then V=ω1×D1/2=ω2×D2/2, from which it follows that $$\omega 2=\omega 1\times D1/D2 \quad (3)$$

Specifically, causing the conveying adjustment roller 61*a* to rotate at an angular velocity ω2 that corresponds with angular velocity ω1 of the conveying roller 51*a* enables the medium to be conveyed at the predetermined rate V. The FC motor controller 113 performs PWM output and drives the FC motor 63 so that the conveying adjustment roller 61*a* will be caused to rotate at angular velocity ω2. The number of rotations made by the FC motor 63 per unit time is detected by the rotation detector 64, and the current angular velocity of the conveying adjustment roller 61*a* is calculated according to the relationship between the detected number of rotations and the gear ratio of the gear train 62. The FC motor controller 113 optimally controls the rate of rotation of the conveying adjustment roller 61*a*, and the same amount of medium per unit time is conveyed between the conveying roller 51*a* and the conveying adjustment roller 61*a*.

According to the present embodiment, the medium is conveyed in a state in which a predetermined tension is maintained between the conveying roller 51*a* and the conveying adjustment roller 61*a*. Therefore, when conveying of the medium is to be started, the main controller 110 causes only the PF motor 53 to rotate in the normal direction before causing the FC motor 63 to start rotating. Specifically, only the conveying roller 51*a* is made to rotate while the conveying adjustment roller 61*a* is stopped. This causes the medium to be placed in a tensioned state between the conveying roller 51*a* and the conveying adjustment roller 61*a*, so that no slackness will be present. Any slackness present in the medium at this point will be detected by a slackness sensor 58 (described further below). Once the slackness in the medium has been eliminated, the FC motor 63 is also caused to rotate in the normal direction, and the rate of rotation of the conveying adjustment roller 61*a* is controlled as described above. Causing the PF motor 53 to rotate in the normal direction and the FC motor 63 to rotate in the reverse direction when conveying of the medium is to start makes it possible to remove any slackness in the medium between the conveying roller 51*a* and the conveying adjustment roller 61*a*. Another possible method entails causing the FC motor 63 to rotate in the normal direction once the slackness has been eliminated from the medium, and controlling the rate of rotation of the conveying adjustment roller 61*a* as described above.

(Controlling Rotation of Roll RP)

The roll RP is caused to rotate in the normal direction by the roll motor 33, whereby the medium is fed (conveyed) towards the conveying adjustment roller 61*a* (conveying roller 51*a*). According to the present embodiment, the amount of rotations made by the roll motor 33 is adjusted, and a control is performed so that an appropriate amount of the medium will be fed to the conveying adjustment roller 61*a* (and the conveying roller 51*a*) in order to create slackness between the conveying adjustment roller 61*a* and the roll RP (see FIG. 8), and to prevent the conveying roller 51*a* from being affected by inertia due to axial misalignment of the roll RP.

In order to cause the medium to slacken between the conveying adjustment roller 61*a* and the roll RP, an amount of slackness that will accommodate, to the extent possible, any effect of axial misalignment of the roll RP must be generated between the conveying adjustment roller 61*a* and the roll RP, before the conveying roller 51*a* rotates when printing is to be performed.

The amount of slackness in the medium is monitored by the slackness sensor 68. As represented in FIG. 8, the slackness sensor 68 used in the present embodiment is arranged on the lower side of the medium between the conveying adjustment roller 61*a* and the roll RP, the slackness sensor 68 detecting the distance to the medium being conveyed (relationship between the positions of the slackness sensor 68 and the medium in the vertical direction) SL1. For example, in a case where the medium is in a totally unslackened state, the vertical distance between the medium and the slackness sensor 68 will be 10 cm. When slack, the medium will sag under its own weight; therefore, the vertical distance between the medium and the slackness sensor 68 will decrease. Therefore, if the target SL1 value to be detected is set at 5 cm, there will be more slackness if the value detected is 5 cm or higher, whereas there will be less slackness if the value is below 5 cm. The degree of slackness in the medium is thus monitored by detecting the vertical distance to the medium (the positional relationship). The slackness sensor 68 need not be a device for measuring the positional relationship relative to the medium; it can be a device allowing the degree of slackness to be visually monitored using a scale.

There follows a description for an instance in the present embodiment where h is used as the target value of SL1. In a case where the distance to the medium SL1 detected by the slackness sensor 68 is h or higher, it means that the amount of slackness in the medium is not below a hypothetical reference value. The roll motor controller 111 thus performs a control so that the roll motor 33 is caused to rotate in the normal direction. More specifically, in a case where the amount of slackness in the medium is equal to or less than a predetermined reference amount, the roll motor 33 is caused to rotate, the medium is dispensed from the roll RP, and an adequate amount of the medium is fed to the medium conveying mechanism 50. Conversely, in a case where the distance to the medium SL1 detected by the slackness sensor 68 has fallen below h, it means that the amount of slackness in the medium is greater than the hypothetical reference value. The roll motor controller 111 thus performs a control to stop the roll motor 33 from rotating. More specifically, in a case where the amount of slackness in the medium is greater than a predetermined reference amount, the medium will stop being fed from the roll RP after a certain amount of time. During printing, the conveying roller 51*a* and the conveying adjustment roller 61*a* convey the medium in the conveying direction at the predetermined rate V. Accordingly, if the medium stops being fed, the amount of slackness in the medium between the conveying adjustment roller 61*a* and the roll RP will gradually decrease. In a case where the SL1 detected by the slackness sensor 68 again reaches or exceeds a predetermined magnitude (h in the above example), the roll motor 33 is caused to rotate in the normal direction and the medium is fed to the medium conveying mechanism 50.

There can be instances where the roll motor 33 will be hard to control immediately after printing commences due to the very large weight of the roll RP. Moreover, the roll motor 33 will conceivably be placed under greater load as a result of repeated, precision control being performed for starting and stopping rotation, as described above. In such cases, the roll motor 33 is caused to rotate first and then stop after a predetermined amount of the medium (e.g., 2 m) has been fed, leaving an adequately large slack portion between the conveying adjustment roller 61*a* and the roll RP. Printing proceeds, the fed portion of the medium is consumed, the roll motor 33 is caused to rotate once more after the amount of slackness has fallen below the predetermined target value, and the roll motor 33 is again stopped after an adequate amount of the medium has been fed. Repeating these actions makes it possible to impart the predetermined amount of slackness or more to the medium between the conveying adjustment roller 61*a* and the roll RP.

Results of the First Embodiment

The medium fed (conveyed) from the roll RP is conveyed along the conveying direction over the conveying adjustment roller 61*a* and the conveying roller 51*a* in the stated order. The rate at which the medium is conveyed is controlled by adjusting the rate of rotation of the conveying roller 51*a*. However, the roll RP is very massive, and inertia due to axial misalignment is generated by its rotation. In particular, if the rotational operation of the conveying roller 51*a* is affected by inertia due to the roll RP when the rate of rotation of the conveying roller 51*a* fluctuates, it will be impossible to control the rotation of the conveying roller 51*a* in an accurate manner, or convey the medium in a stable manner.

In the present embodiment, the conveying adjustment roller 61*a* is provided between the conveying roller 51*a* and the roll RP, and the amount of rotation made by the various motors is controlled so as to ensure that the medium will have adequate slackness between the conveying adjustment roller 61*a* and the roll RP. More specifically, during the time that the roll RP makes a single rotation, a control is performed so that the maximum amount of medium conveyed from the roll RP per unit time will be greater than the maximum amount of medium conveyed per unit time by the conveying roller 51*a* and the conveying adjustment roller 61*a*. This causes any effect on the conveying roller 51*a* from inertia due to the axial misalignment of the roll RP to be absorbed by the slack portion of the medium between the conveying adjustment roller 61*a* and the roll RP, so that the effect of the inertia does not reach the conveying roller 51*a* downstream in the conveying direction. Since the conveying roller 51*a* remains unaffected by inertia, the medium can be conveyed with precision.

According to the present embodiment, the medium is conveyed under a given amount of tension between the conveying roller 51*a* and the conveying adjustment roller 61*a*. More specifically, the medium will experience no slackness or wrinkling on the side of the conveying roller 51*a* that is downstream in the conveying direction. This ensures the medium is devoid of slackness in the zone where printing actually takes place (on the platen 55), leading to minimal incidence of problems such as variation in the landing position of the dots of ink sprayed from the head, and enabling exceptional print quality to be achieved.

Modification of the First Embodiment

Figure 9:
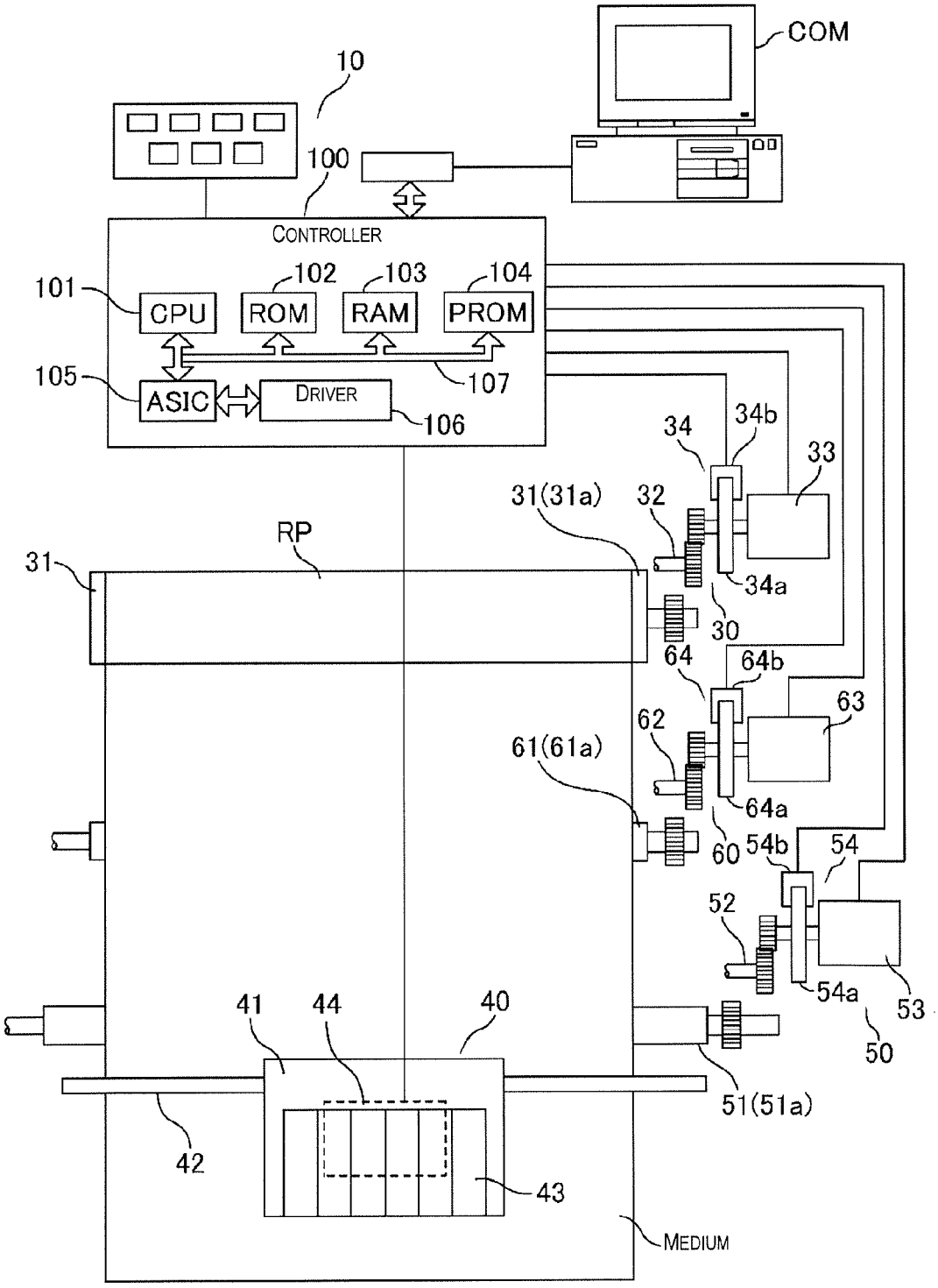
FIG. 9 is a diagram representing the relationship between a control system and a drive system employing a DC motor in a modification example of the first embodiment.
Figure 10:
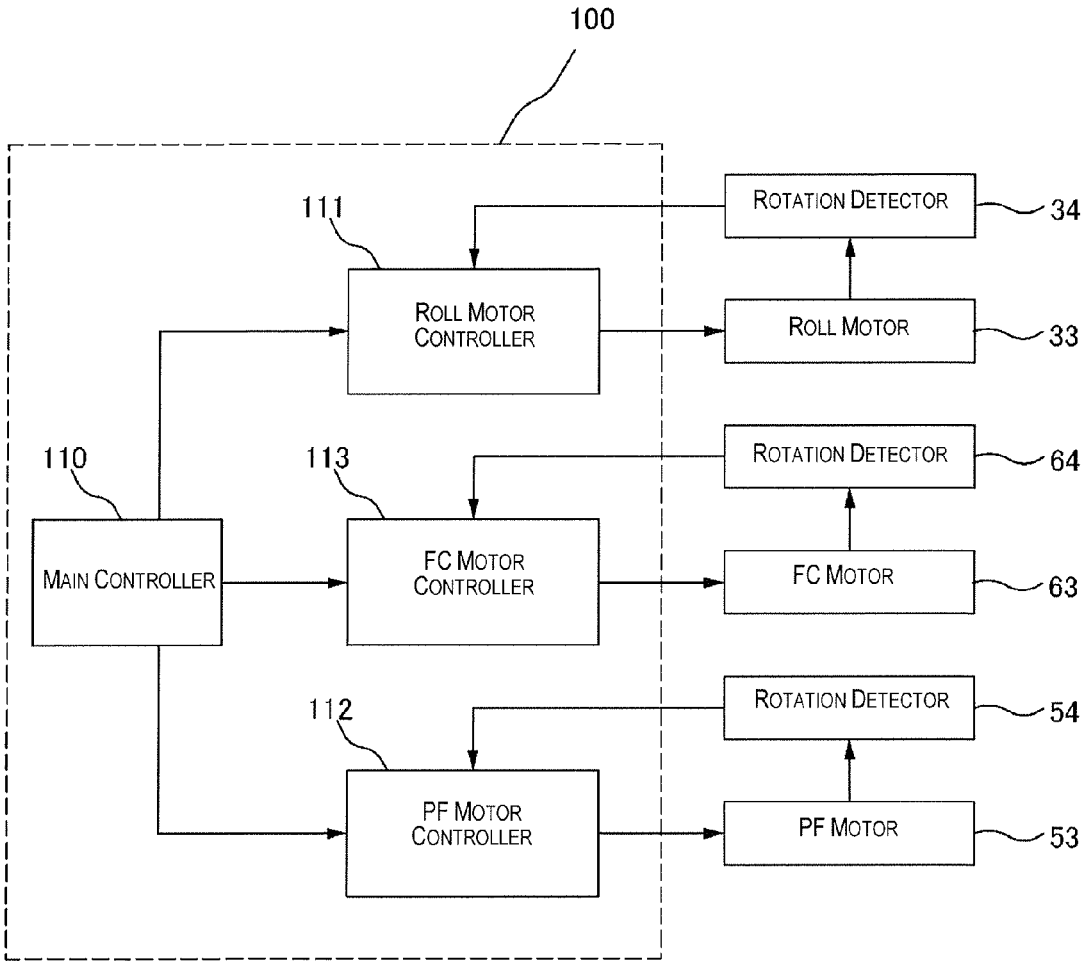
FIG. 10 is a block diagram representing a functional configuration example of a controller in a modification of the first embodiment.

According to the embodiment described above, a slackness sensor 68 is used to detect the amount of slackness in the medium between the roll RP and the conveying adjustment roller 61*a*; however, the amount of slackness in the medium can also be detected using another method. FIG. 9 represents the relationship between a drive system using a DC motor and a control system in a modification of the first embodiment. FIG. 10 is a block diagram representing a functional configuration example of a controller 100 in a modification of the first embodiment. A rotation detector 34 is present in the roll driving mechanism 30 in the present modification (FIG. 9); therefore, a slackness sensor 68 is no longer needed. Other structures related to the printer are the same as described for the first embodiment.

A rotary encoder similar to the rotation detectors 54, 64 is used for the rotation detector 34, which includes a disc-shaped scale 34*a*, and a rotary sensor 34*b*. At fixed intervals along the circumferential direction of the disc-shaped scale 34*a* are arranged a light transmission part for transmitting light, and a light-blocking part for blocking light transmission. The rotary sensor 34*b* has, as primary structural elements, a light-emitting element, a light-receiving element, and a signal-processing circuit (none of which shown in the drawing). The rotation detector 34 of the roll motor 33 and the rotation detector 64 of the FC motor 63 are used to detect the amount of rotation made by the respective motors, whereby the amount of slackness is calculated (FIG. 9). Specifically, it is possible to obtain the amount of medium fed (delivered) Feed_roll from the amount of rotation made by the roll motor 33 as obtained from the rotation detector 34, and the diameters of the gear train 32 and the roll RP. Therefore, since the medium fed the roll RP (roll paper) will be gradually consumed through printing, the roll diameter of the roll RP will vary as printing progresses. Accordingly, the diameter of the roll RP will be estimated on the basis of the amount of medium already conveyed. It is also possible to obtain the amount of medium conveyed Feed_fc from the amount of rotation made by the FC motor 63 as obtained from the rotation detector 64, and the diameters of the gear train 62 and the conveying adjustment roller 61*a*. It is thus possible to estimate the current amount of slackness by subtracting the conveyed amount Feed_fc from the fed amount Feed_roll. Other than by detecting the amount of slackness, control over the rollers can be performed using the same method employed in the first embodiment.

Second Embodiment

Figure 11:
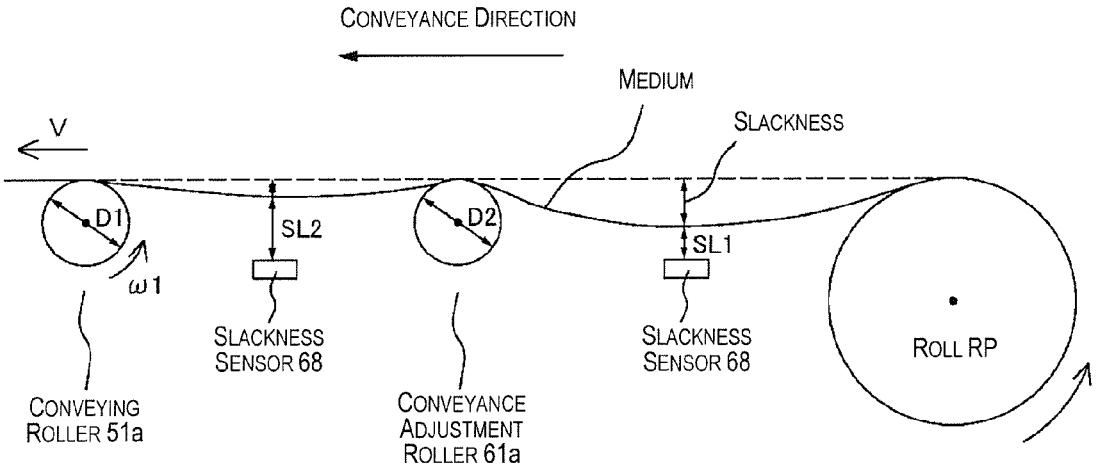
FIG. 11 is a diagram schematically depicting rotation of various rollers and slackness of a medium when a medium is conveyed in a second embodiment.
Figure 12:
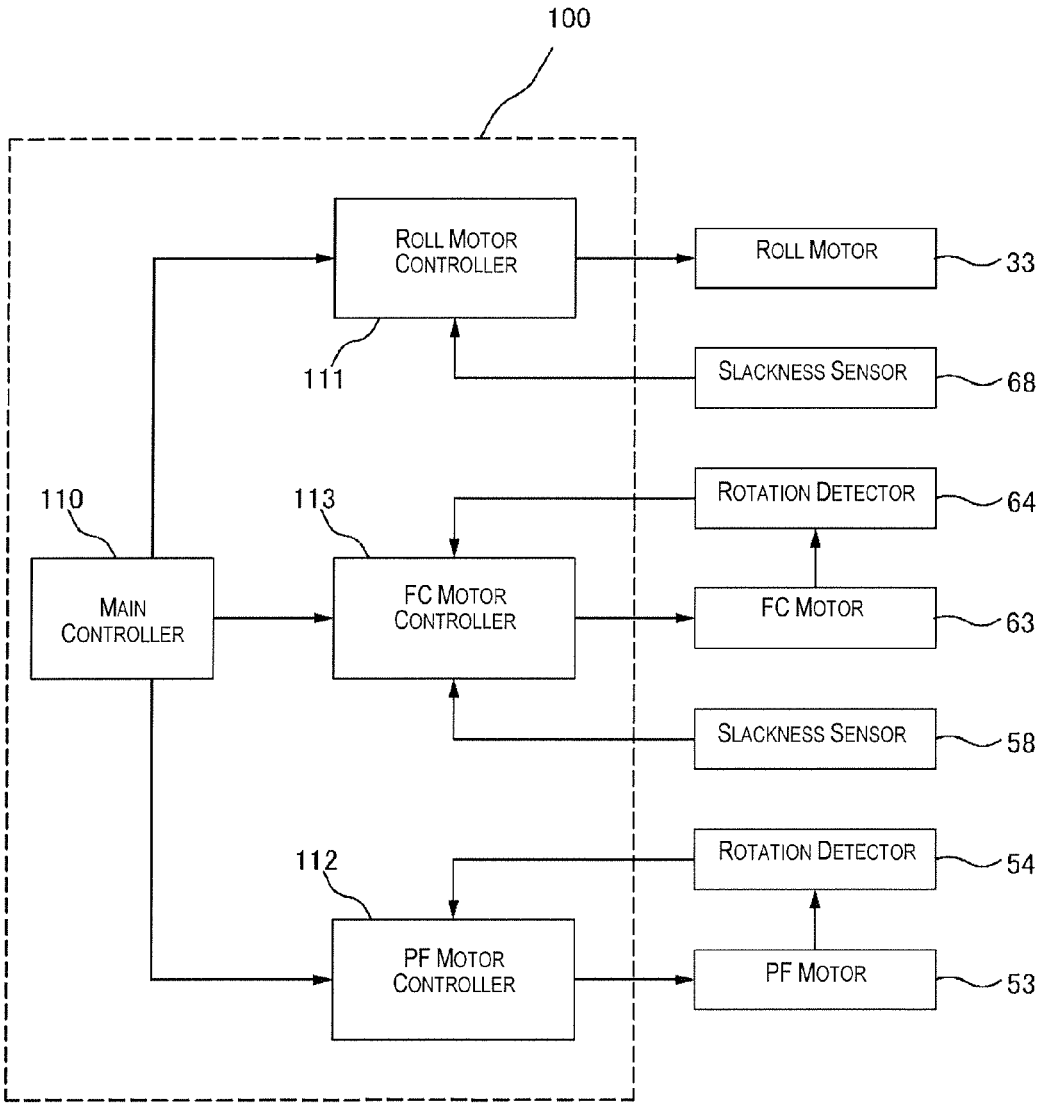
FIG. 12 is a block diagram representing a functional configuration example of a controller in the second embodiment.

According to the second embodiment as well, a control is performed based on the amount of slackness in the medium between the conveying adjustment roller 61*a* and the conveying roller 51*a*. FIG. 11 is a schematic representation of the rotation made by the variety of rollers and the state of slackness in the medium when the medium is conveyed in the second embodiment. FIG. 12 is a block diagram representing a functional configuration example of the controller 100 in the second embodiment. According to the second embodiment, a slackness sensor 58 is provided between the conveying adjustment roller 61*a* and the conveying roller 51*a* in order to detect the amount of slackness in the medium therebetween (FIG. 11). The slackness sensor 58 is capable of detecting the position of the medium in the vertical direction (the relative position between the slackness sensor 58 and the medium in the vertical direction) between the conveying adjustment roller 61*a* and conveying roller 51*a*, the sensor being arranged on the lower side of the medium, as with the slackness sensor 68. Using the slackness sensor 58 makes it possible to ascertain the "amount of slackness," which expresses how much slackness is present in the vertical direction at the conveying position in a case where the medium is being conveyed in an unslackened (tensioned) state. All of the structures other than the slackness sensor 58 are the same as in the first embodiment.

Controlling Rotation of Conveying Roller 51*a*

The conveying roller 51*a* is controlled in the same manner as in the first embodiment. Specifically, the medium is conveyed in the conveying direction at a given rate V; therefore, the conveying roller 51*a* is caused to rotate at angular velocity $\omega 1$ such that $V=\omega 1 \times D1/2$. The PF motor controller 112 performs PWM output and drives the PF motor 53 so that the conveying roller 51*a* will be caused to rotate at angular velocity $\omega 1$. The amount of rotation made by the PF motor 53 per unit time is monitored by the rotation detector 54. Detecting the amount of rotation made by the PF motor 53 allows the current angular velocity of the conveying roller 51*a* to be calculated according to the relationship relative to the gear ratio of the gear train 52. As a consequence thereof, the PF motor controller 112 properly controls the rate of rotation of the conveying roller 51*a* and stably conveys the medium.

Controlling Rotation of Conveying Adjustment Roller 61*a*

The amount of rotation of the conveying adjustment roller 61*a* is controlled on the basis of the amount of slackness detected by the slackness sensor 58. As represented in FIG. 11, the slackness sensor 58 is arranged on the lower side the medium between the conveyor roller 51*a* and the conveying adjustment roller 61*a*, the slackness sensor 68 detecting the distance to the medium being conveyed (relationship between the positions of the slackness sensor and the medium in the vertical direction) SL2.

The FC motor controller 113 controls the FC motor 63 so that the amount of slackness in the medium will be a predetermined target amount of slackness. For example, the current amount of slackness is calculated from the SL2 value detected by the slackness sensor 58, duty control involving PID control is performed so that the deviation obtained by subtracting the calculated current amount of slackness from the target amount of slackness is zero, and the FC motor 63 is caused to rotate. This makes it possible for the medium to be conveyed while ensuring the slackness is kept at a suitable amount. In a case where the amount of slackness is set to 0 mm, the medium will be conveyed in an unslackened state between the conveying adjustment roller 61*a* and the conveyor roller 51*a*.

Controlling Rotation of Roll RP

The rotation of the roll RP is controlled in the same manner as in the first embodiment. Specifically, the amount of slackness in the medium between the roll RP and the conveying adjustment roller 61*a* is equal to or greater than a predetermined amount, and the medium is consistently conveyed in a slackened state.

Effect of the Second Embodiment

In the second embodiment, as in the first embodiment, the motors are controlled so that the medium will definitely have an adequate amount of slackness between the conveying adjustment roller 61*a* and the roll RP. This allows the slack portion to absorb the effect of inertia due to axial misalignment, which is a problem when variation occurs in the rate at which the conveyor roller 51*a* rotates, and the effect of the inertia does not reach the conveyor roller 51*a* downstream in the conveying direction. Since the conveyor roller 51*a* does not experience any effect of the inertia, the medium can be conveyed with precision. According to the present embodiment, the motors are controlled to manage the amount of slackness in the medium between the conveyor roller 51*a* and the conveying adjustment roller 61*a*. It is thereby possible to impart slackness to the medium in this segment. Moreover, since the target amount of slackness can be set as required, the medium can be optimally conveyed in accordance with the material and type thereof used during printing. For example, when a thin medium is to be used in printing, it can be advisable for the tension to be set higher in order to prevent wrinkling. In such instances, the target amount of slackness is set to 0 mm. If a highly wrinkling-resistant medium is used, the target amount of slackness is set higher so that the rotational action of the conveyor roller 51*a* will not be subjected to excessive loading. These and other measures enable the medium to be conveyed in a manner ideally suited to a variety of printing conditions.

Modification of Second Embodiment

Figure 13:
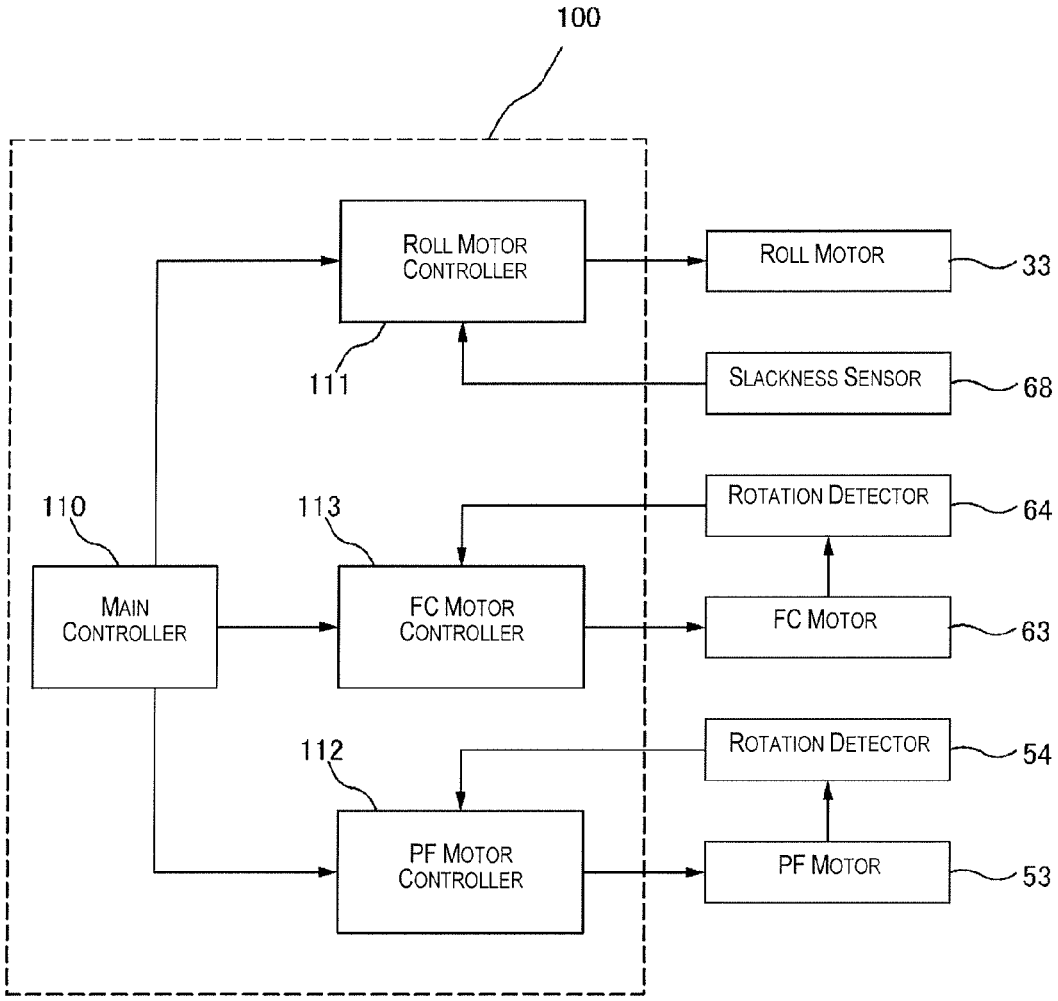
FIG. 13 is a block diagram representing a functional configuration example of a controller in a modification example of the second embodiment.

In order to detect the amount of slackness in the medium between the conveying adjustment roller 61*a* and the conveyor roller 51*a*, the amount of slackness can be controlled based on the amount of rotation made by the various motors, without using the slackness sensor 58. Other than the fact that the slackness sensor 58 is not required, the printer is configured in the same manner as in the second embodiment. FIG. 13 is a block diagram representing a functional configuration example of the controller 100 in the modification of the second embodiment. In the present modification, the same method as that described above for the modification of the first embodiment makes it possible to obtain the amount of medium conveyed (delivered) Feed_pf from the amount of rotation made by the PF motor 53 as obtained from the rotation detector 54, and the diameters of the gear train 52 and the conveyor roller 51*a*. Additionally, the amount of medium conveyed (delivered) Feed_fc can be obtained from the rate of rotation of the FC motor 63 as obtained from the rotation detector 64, and the diameters of the gear train 52 and the conveying adjustment roller 61*a*. It is thus possible to estimate the current amount of slackness by subtracting the conveyed amount Feed_fc from the fed amount Feed_pf.

Other Embodiments

Although a printer or the like has been described as an embodiment, the above embodiments shall not be construed as being of limitation to the invention, and are intended to facilitate the understanding thereof. It shall be apparent that the invention can be altered or improved upon as long as no departure is made from its main points, and that equivalent articles are included in its scope. Such articles are included in the scope of the invention particularly with respect to the embodiments discussed below.

In the embodiments outlined in the foregoing, the motor controllers are described as being provided to the printer 10. However, the motor controllers need not be provided to the printer 10; they can be employed in fax machines or other devices in which a roll (roll paper) is used.

(Printer)

In the embodiments described above, an example is cited of a printer 10 of serial-scanning type having a head that moves in tandem with a carriage; however, the printer can also be a so-called line printer in which the head is immobilized.

The printer 10 can also be a component of a composite device such as a scanner or a photocopier. The printer 10 is described in the embodiments outlined above as being of an inkjet format; however, as long as the printer 10 is capable of spraying a fluid, an inkjet format shall not be provided by way of limitation. For example, the present embodiment is applicable to gel jet printers, toner-based printers, dot-impact printers, and other varieties of printers. With line printers in particular, axial misalignment can adversely affect how the medium is conveyed and where the printing is positioned; alter the ink landing height or other parameters and degrade image quality; or cause other problems to occur. Therefore, adapting the present embodiment can improve the conveying precision as well as the image quality.

(Ink)

The above embodiments allow four-color (CMYK) printing to be performed using colored inks. Dye-based inks, pigment-based inks, or other inks can be used. Printing can also be performed using non-CMYK inks such as those colored light cyan, light magenta, white, or clear.

(Medium)

Roll paper is used as the medium in the above embodiments; however, film-form members, resin sheets, aluminum foils, or other media can be used instead of paper.

(Controller)

The controller 100 is not limited to being the controller used in the embodiments above; and can be configured so that, e.g., control of the roll motor 33, the PF motor 53, and the FC motor 63 is performed solely by the ASIC 105. It is also possible for the controller 100 to be combined into an integrated package with a single-chip microcomputer or other system having built-in peripheral devices other than those described above.

What is claimed is:

1. A printer comprising:

a roll driving mechanism including a roller, configured to cause the roll onto which a medium has been wound in a roll form to rotate, and convey the medium in a conveying direction;

a roll driving section configured to drive the roll driving mechanism;

a first conveying section configured to convey the medium, the first conveying section being provided downstream from the roll in the conveying direction;

a first driving section configured to drive the first conveying section;

a print head configured to perform printing on the medium, the print head being provided downstream from the first conveying section in the conveying direction;

a second conveying section configured to convey the medium, the second conveying section being a pair of rollers, the second conveying section being provided between the roll and the first conveying section;

a second driving section configured to drive the second conveying section;

a controller configured to control operation of the roll driving section, the first driving section, and the second driving section such that, during a single rotation of the roll, the maximum amount of the difference between the amount of the medium conveyed by the roll driving mechanism and the amount of the medium conveyed by the second conveying section exceeds the maximum amount of the difference being between the amount of the medium conveyed by the second conveying section and the amount of the medium conveyed by the first conveying section.

2. The printer according to claim 1, wherein during an interval from when the first conveying section starts conveying the medium to when the first conveying section ends conveying the medium, the controller controls the operation of the roll driving section, the first driving section, and the second driving section in such a way that the maximum amount of the difference between the amount of the medium conveyed by the roll driving mechanism and the amount of the medium conveyed by the second conveying section exceeds the maximum amount of the difference between the amount of the medium conveyed by the second conveying section and the amount of the medium conveyed by the first conveying section.

3. The printer according to claim 1, wherein during an interval from when printing starts to when printing ends, the controller controls the operation of the roll driving section, the first driving section, and the second driving section in such a way that the maximum amount of the difference between the amount of the medium conveyed by the roll driving mechanism and the amount of the medium conveyed by the second conveying section exceeds the maximum amount of the difference between the amount of the medium conveyed by the second conveying section and the amount of the medium conveyed by the first conveying section.

4. The printer according to claim 1, further comprising an amount-of-slackness detector for detecting the amount of slackness in the medium between the roll driving mechanism and the second conveying section, wherein the controller drives the roll driving mechanism in a case where the amount of slackness detected by the amount-of-slackness detector is equal to or less than a predetermined amount of slackness, and stops the roll driving mechanism in a case where the amount of slackness detected by the amount-of-slackness detector exceeds the predetermined amount of slackness.

5. The printer according to claim 1, wherein the controller detects the amount of slackness in the medium between the roll driving mechanism and the second conveying section on the basis of the amount of the medium conveyed by the roll driving mechanism and the amount of the medium conveyed by the second conveying section, the controller drives the roll driving mechanism in a case where the detected amount of slackness is equal to or less than a predetermined amount of slackness, and stops the roll driving mechanism in a case where the detected amount of slackness exceeds the predetermined amount of slackness.

6. The printer according to claim 1, wherein the controller controls the operation of the roll driving section, the first driving section, and the second driving section based on an amount of slack between the roll and the second conveying section, the amount of slack indicates a slack amount of the medium slacking in a slacking direction relative to a hypothetical line that indicates a conveyance route where the medium is conveyed without slacking in the slacking direction between the roll and the second conveying section, and the slacking direction intersects the conveying direction.

7. A printing method comprising:

driving a roll driving mechanism for driving a roll on which a medium has been wound in roll form and conveying the medium in a conveying;

driving a first conveying section provided downstream from the roll in the conveying direction such that the first convey section conveys the medium;

printing on the medium by a print head provided downstream from the first conveying section in the conveying direction;

driving a second conveying section provided between the roll and the first conveying section such that the second conveying section conveys the medium, the second conveying section being a pair of rollers; and during a single rotation of the roll, controlling the driving of the roll driving mechanism, driving of the first conveying section, and the driving of the second conveying section such that the maximum amount of the difference between the amount of the medium conveyed by the roll driving mechanism and the amount of the medium conveyed by the second conveying section to exceed the maximum amount of the difference being between the amount of the medium conveyed by the second conveying section and the amount of the medium conveyed by the first conveying section.

* * * * *